US005566735A

United States Patent [19]

Jelic

[11] Patent Number: 5,566,735

[45] Date of Patent: Oct. 22, 1996

[54] ROMAN-TYPE SHADE

[75] Inventor: Ralph Jelic, Valencia, Pa.

[73] Assignee: Verosol USA Inc., Pittsburgh, Pa.

[21] Appl. No.: 411,937

[22] Filed: Mar. 28, 1995

[51] Int. Cl.[6] ..... E06B 9/06

[52] U.S. Cl. ..... 160/84.04

[58] Field of Search ..... 160/84.01, 84.02, 160/84.03, 84.04, 84.05, 84.06, 348

[56] References Cited

U.S. PATENT DOCUMENTS

| | | | |
|---|---|---|---|
| 1,321,800 | 11/1919 | Andress et al. . | |
| 4,694,545 | 9/1987 | Dernis | 29/1 R |
| 4,846,243 | 7/1989 | Schneider | 160/84.02 |
| 4,880,044 | 11/1989 | Judkins | 160/84.04 |
| 4,921,032 | 5/1990 | May | 160/84.01 |
| 4,945,969 | 8/1990 | Schnebly et al. | 160/84.02 |
| 5,207,256 | 4/1993 | Kraeutler | 160/84.1 |
| 5,273,096 | 12/1993 | Thomsen et al. | 160/84.1 |
| 5,313,998 | 5/1994 | Colson et al. | 160/84.1 |
| 5,355,928 | 10/1994 | Robertson | 160/348 X |

*Primary Examiner*—David M. Purol

*Attorney, Agent, or Firm*—Buchanan Ingersoll, P.C.; Lynn J. Alstadt

[57] ABSTRACT

An improved Roman shade has a series of parallel, generally U-shaped ribs which grip the shade fabric at selected intervals to provide a series of cascading transverse pleats. Each rib is formed by a pair of legs connected together at a proximate end to form a top and abutting one another at their distal end to define a fabric receiving cavity therebetween. At least one cord carrier is attached to the top or one leg of each U-shaped rib and connected to a spacer cord.

20 Claims, 6 Drawing Sheets

ROMAN-TYPE SHADE

FIELD OF INVENTION

The invention relates to Roman-type shades.

BACKGROUND OF THE INVENTION

One popular type of window covering is known as a Roman shade. This type of shade consists of a fabric material attached along its top edge to a headrail and gathered at spaced intervals to provide a series of soft folds across the face of the fabric. Consequently, the Roman shade has a cascaded or softly pleated appearance.

The most common practice for making a Roman shade is to sew at least two sets of rings or connectors along vertical lines down the back of the fabric material such as is shown in U.S. Pat. No. 1,321,800. In one type of Roman shade a lift cord passes from the headrail through each set of rings and may either be fastened to the bottom edge of the fabric or loop around the bottom edge of the fabric up the front face of the fabric and return to the headrail. In another type of Roman shade, each set of connectors is both sewn to the fabric and attached to a cord at spaced apart intervals along the cord. The interval between spacers on each cord may be equal to or less than the distance between the points at which the spacers are attached to the back of the fabric.

Because it takes a substantial amount of time to sew connectors to the back of the fabric for a Roman shade, the art has developed other ways to connect the fabric to the cord. In the window covering disclosed in U.S. Pat. No. 4,694,545 a set of U-shaped filaments are inserted through the fabric from the front. The ends of each filament are gathered in a tube, bent over the end of the tube and held in place by a sleeve that fits over the tube. This system has a large number of small pieces. Most shade fabricators prefer not to use systems that have large numbers of small parts that must be assembled.

The art has also utilized one or more transverse ribs to provide support or maintain spacing between the cords which are oriented vertically across the back of the fabric. Examples of such ribs are shown in U.S. Pat. No. 5,207,256 wherein the ribs are placed within spaced apart transverse pockets in the fabric. In this system the pockets must be sewn into the material.

Thomsen et al. in U.S. Pat. No. 5,273,096 disclose a shade in which a set of parallel rods are placed on one side of the fabric. A tubular member having a longitudinal opening fits over each rod gripping the fabric therebetween. Loops are provided on the tubular members through which lift cords pass. If this system is used on a Roman shade for a large window the tube and rod combinations will add substantial weight to the shade. Moreover, the tubes and rods add substantial cost to such a shade.

There is a need for a light weight Roman shade which can be quickly assembled by the fabricator. The shade should have a spacer system that can be connected to the fabric without sewing and is both light weight and inexpensive.

SUMMARY OF THE INVENTION

I provide a Roman shade in which the fabric is held by ribs to a spacer cord. The ribs are generally U-shaped having a pair of legs which define a fabric holding cavity within the rib. The fabric for the shade is folded and slid between the legs of the rib. I prefer to provide at least one locking tooth on the inside surface of the legs in the lower portion. Each rib has a series of equally spaced holes across its length which are adapted to receive cord carriers. The cord carriers each have one end that fits into a rib and has a hole through which a lift cord can be routed. A set of cord carriers is preferably molded onto each spacer cord to provide means for controlled spacing. The ribs are attached to the rear portion of the fabric and extend between spacer cords near the opposite sides of the shade. The fabricator can place any desired number of spacer cords and attached cord carriers along the length of the rib using more spacer cords for a heavier, wider fabric and fewer spacer clips for a lighter, narrower fabric.

The cord carriers are connected to spacer cord at any desired interval. I prefer 4" to 5" intervals. Consequently, the system can be used for all types of flat fabrics to create evenly spaced folds.

Other objects and advantages will become apparent from the description of certain present preferred embodiments shown in the drawings.

DESCRIPTION OF THE PREFERRED EMBODIMENTS

Figure 1:
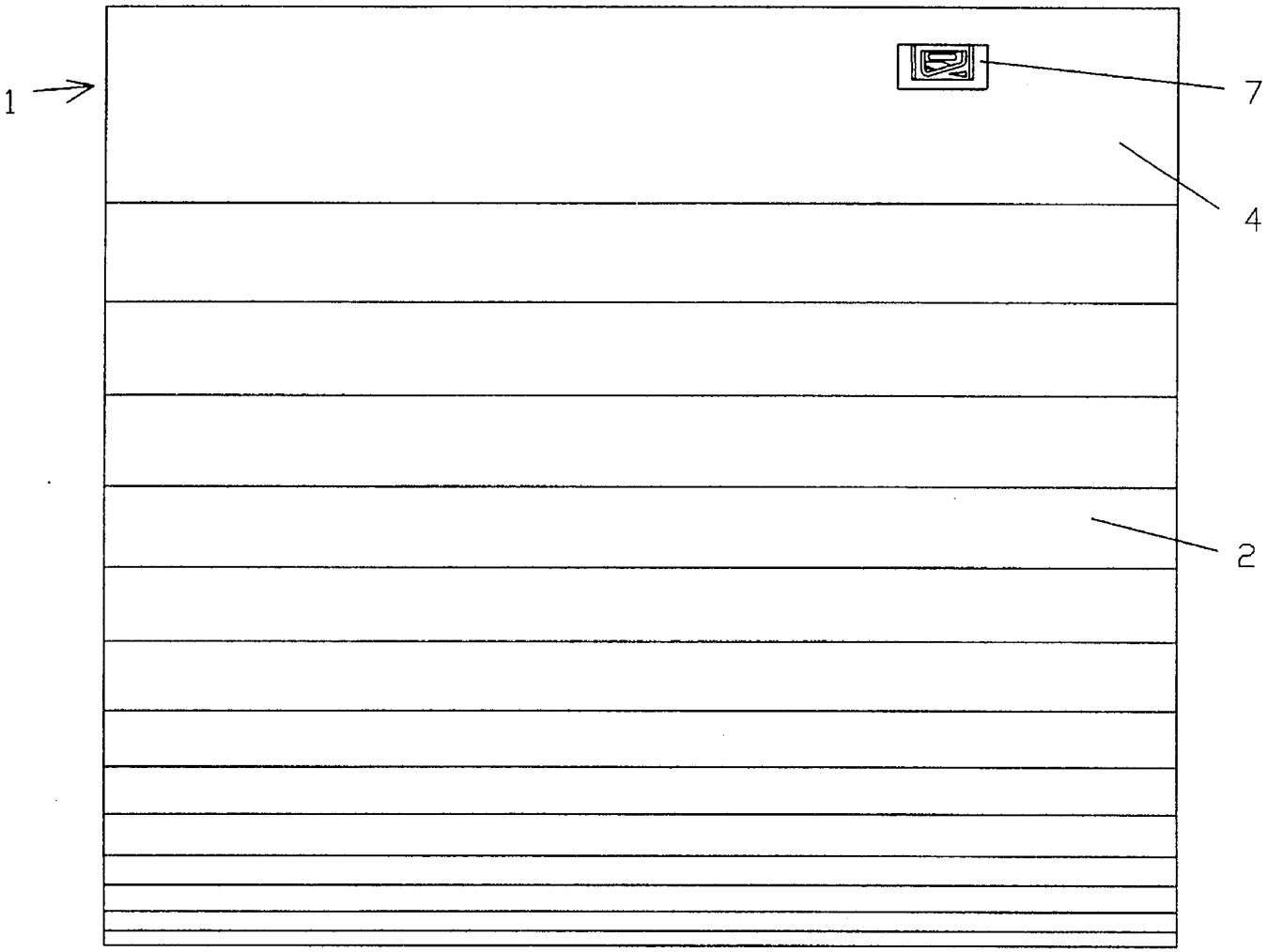
FIG. 1 is a front view of the present preferred embodiment of my new style Roman shade in a raised position.
Figure 2:
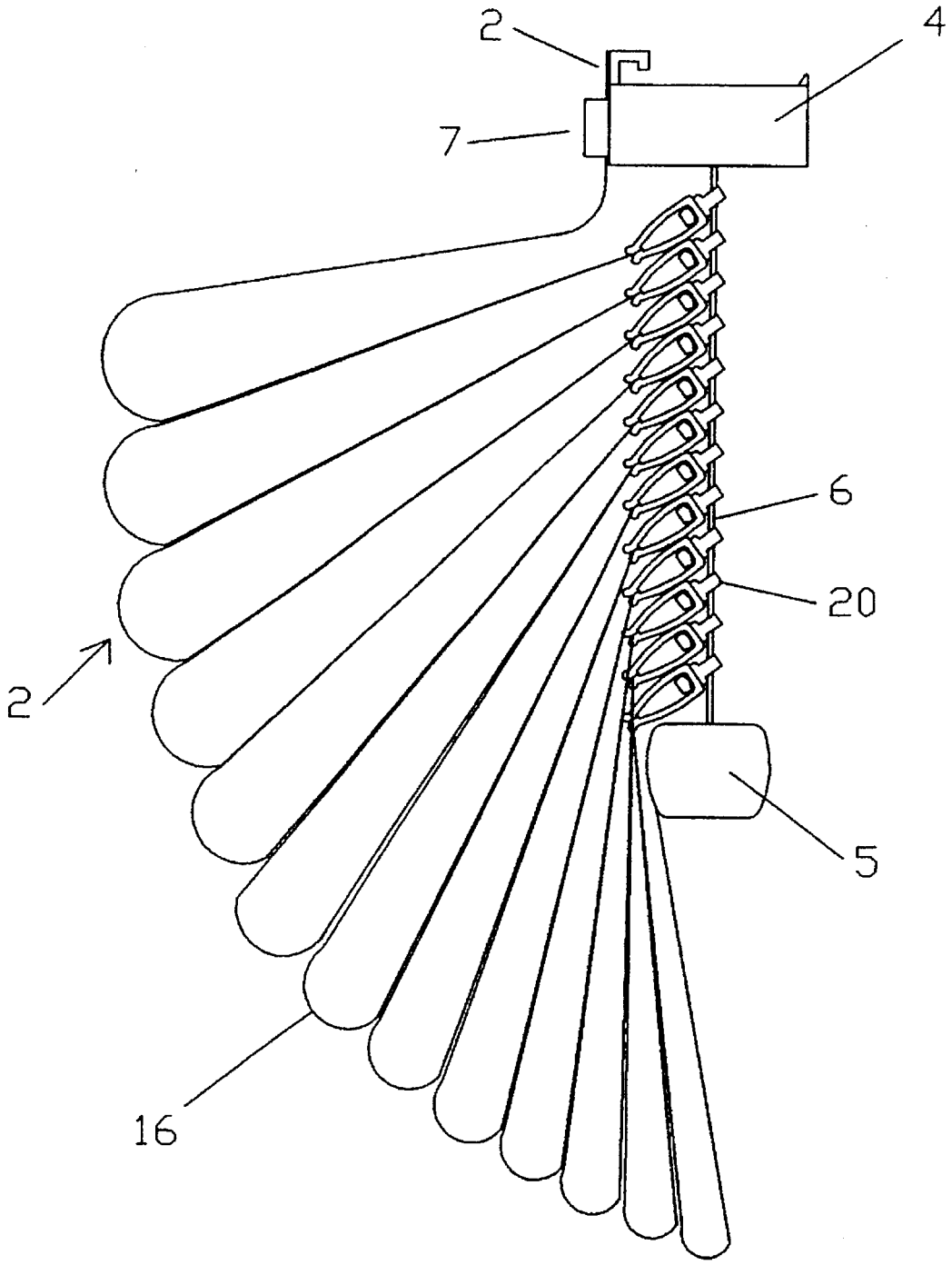
FIG. 2 is a side view of the embodiment shown in FIG. 1 in a raised position.

Referring to FIGS. 1 thru 5, my Roman shade 1 is comprised of a sheet of fabric material 2 which is not pleated. A top edge of the fabric is connected to a headrail 4 and the bottom edge of the fabric is connected to a bottom rail 5. I prefer that the fabric extend over the front face of the headrail as shown in FIG. 2 creating a headrail having its own valance. A pair of lift cords 6 pass through cord lock 7, run down the back of the shade and are attached to the bottom rail 5. A pair of spacer cords 8 run down the back of the shade and are attached to the headrail and the support ribs. In the embodiment shown in the drawings, the lift cords are positioned behind the spacer cords.

Figure 3:
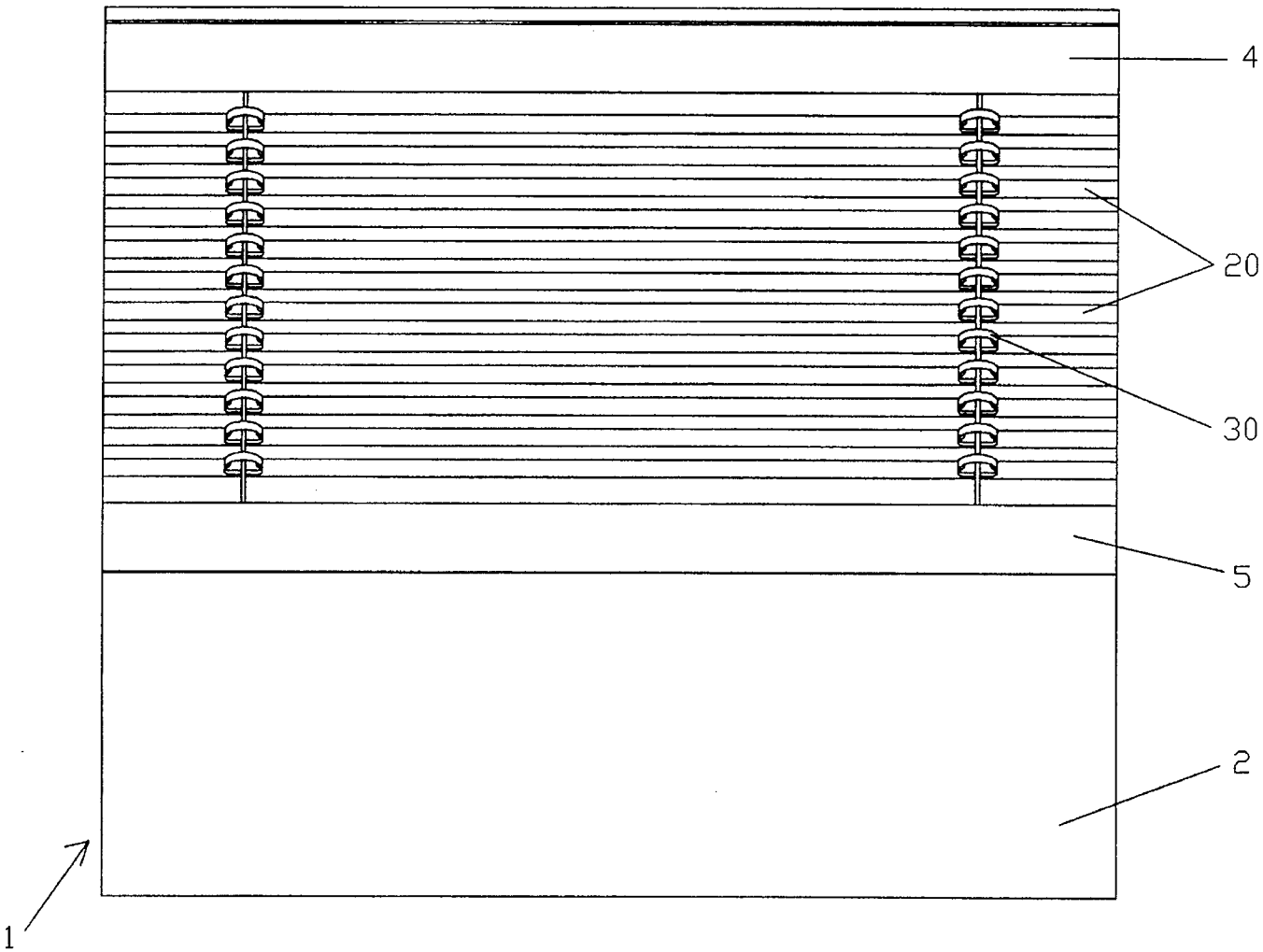
FIG. 3 is a rear view of the embodiment of FIGS. 1 and 2 in raised position.
Figure 5:
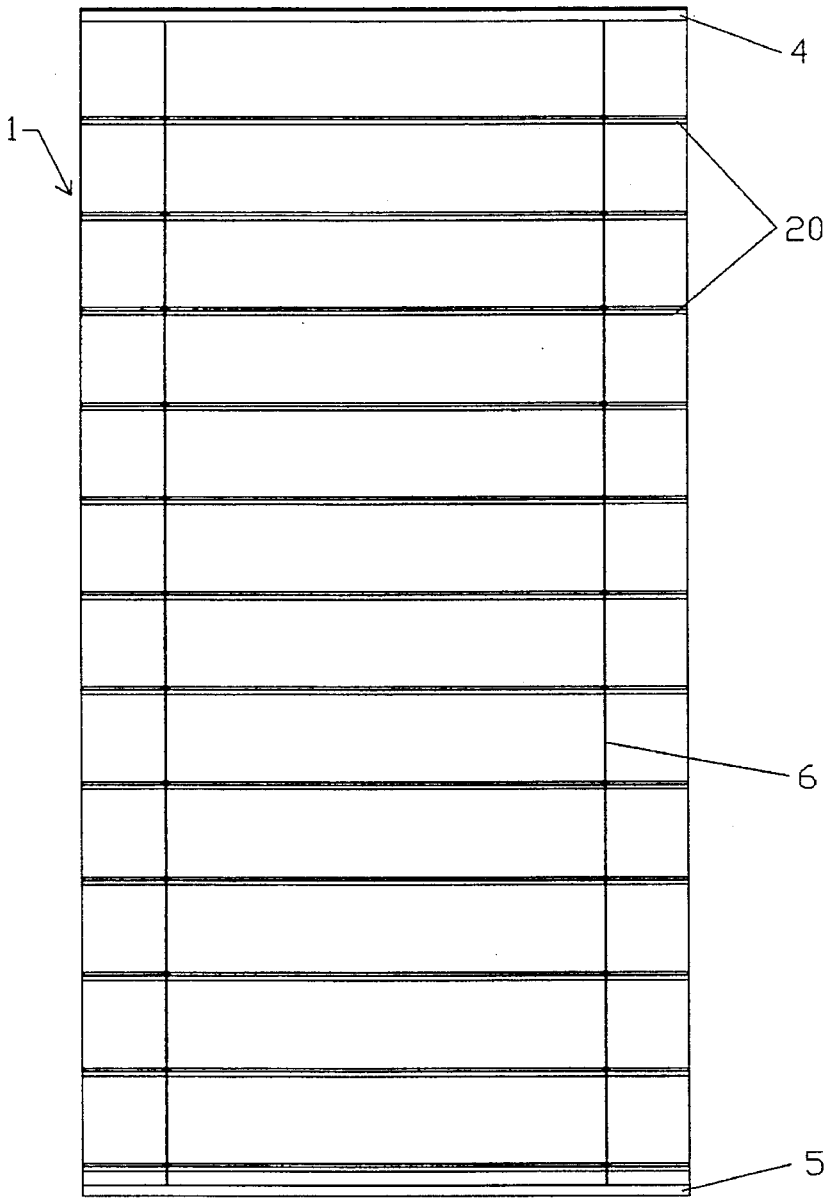
FIG. 5 is a rear view of the embodiments of FIGS. 1 thru 4 in a fully lowered position.
Figure 6:
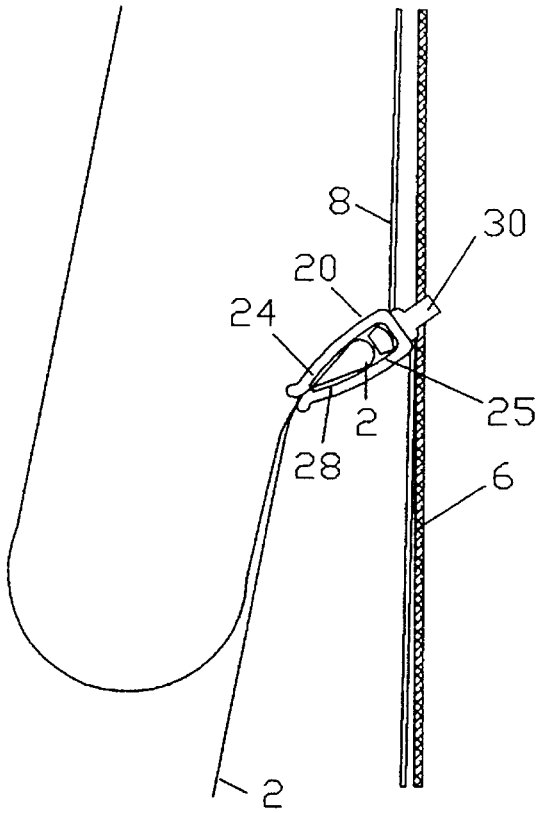
FIG. 6 is an enlarged side view of a presently preferred rib in cross section and connected cord carrier with a lift cord running through the cord carrier.

As seen most clearly in FIGS. 3 and 5, I prefer to provide a series of transverse ribs 20 across the rear face of the fabric. The ribs preferably extend across the complete width of the fabric. Holes 23 are provided along the rib. The holes preferably are 3/32 inch in diameter and spaced apart on ¾ inch centers. The ribs can be plastic extruded parts which are drilled or punched immediately after-extrusion. The ribs 20 need not have holes if the cord carriers 30 are attached by glue or other means to the ribs. For most shade sizes and materials two cord carriers are attached to each rib 20. However, the fabricator can place any desired number of spacer cords and attached cord carriers along the length of the rib using more spacer cords for a heavier, wider fabric and fewer spacer clips for a lighter, narrower fabric.

Figure 7:
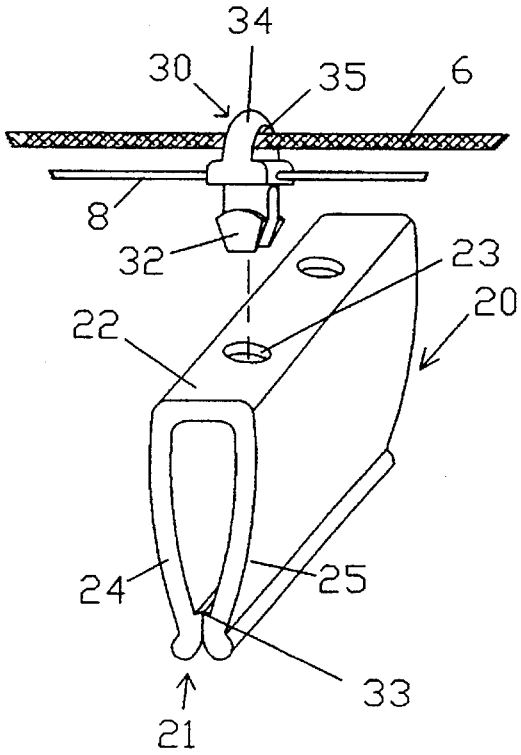
FIG. 7 is an exploded view of the present preferred cord carrier and section of the rib in FIG. 6.

The ribs have a generally U-shaped lower portion 21 formed by a pair of legs 24 and 25 connected together at a proximate end to form a top 22 and abutting one another at their distal end to define a fabric receiving cavity 28 therebetween. I prefer to provide a set of teeth 33 on the inside surface of the ribs. The ribs are preferably molded from ABS plastic or roll formed from aluminum. It is also possible to provide a different plastic material on the inside surface of the ribs such as a softer vinyl to improve the friction between the rib surface and the fabric placed within the rib. In one embodiment a hole 23 is provided on the top 22 of the rib 20. As can be seen most clearly in FIG. 7, a cord carrier 30 having a pair of locking arms 32 fits into the hole 23 in the top 22 of the rib. The cord carrier has a top 34 having a cord hole 35 through which a lift cord 6 passes. The spacer cord 8 passes through a smaller hole 36 and preferably runs parallel to the lift cord 6. Preferably, the cord carrier is injection molded around the spacer cord. The process of molding the cord carriers on the spacer cords will firmly attach the cord carrier to the spacer cord. I prefer that the cord carriers be placed at 4 or 5 inch intervals along the spacer cord.

Figure 8:
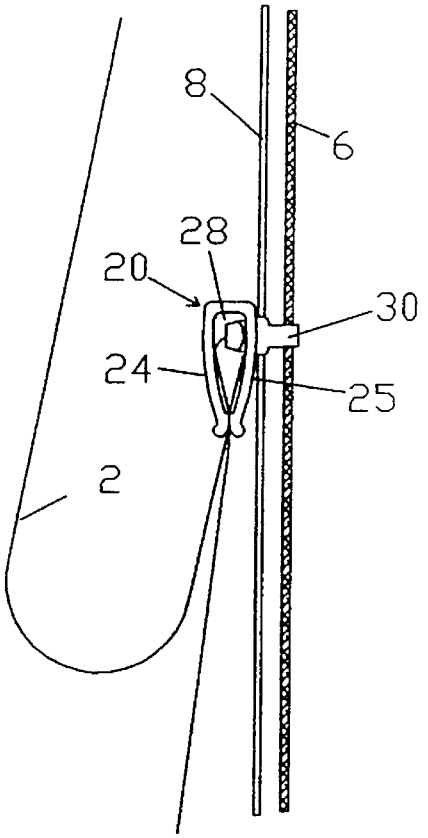
FIG. 8 is an enlarged side view partially in section showing a second preferred attachment of the cord carrier to the rib.
Figure 9:
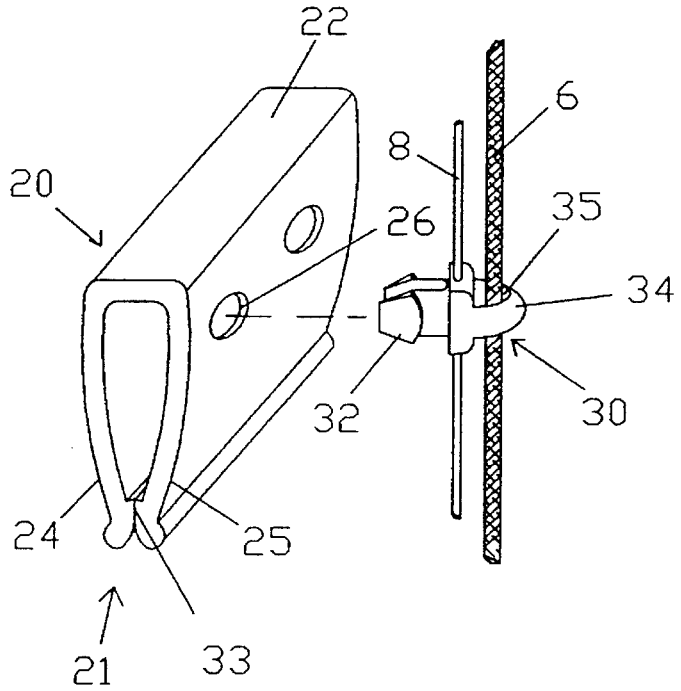
FIG. 9 is an exploded view of the embodiment of FIG. 8.

If desired the cord carriers could be inserted into holes 26 provided in one leg 25 of the ribs as shown in FIGS. 8 and 9. I have found that this arrangement gives the shade a flatter appearance when in a fully lowered position.

Figure 4:
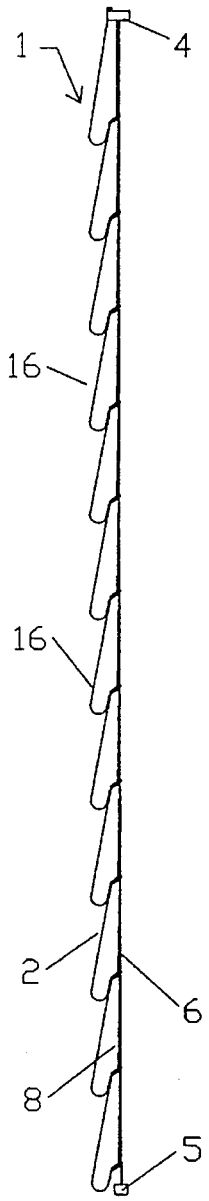
FIG. 4 is a side view similar to FIG. 2 showing the embodiment of FIGS. 1 thru 3 in a fully lowered position.

Referring now to FIGS. 2 and 4, the fabric 2 is gathered at desired intervals to form small folds 16 which are fitted within the lower portion 21 of rib 20. I prefer that there be a sufficient length of fabric provided between ribs so that the fabric exiting the top portion of the rib will drop and then curve up to be held up by the rib to provide a cascading appearance when the shade is in a fully lowered position such as is shown in FIG. 4. The same appearance will be maintained when the shade is moved to a raised position as shown in FIG. 2. However, the fabric loop 16 will extend outwardly from the shade a much greater distance. I further prefer that when the shade is in a lowered position such as shown in FIG. 4, the base of the lower most loop will not extend below the bottom rail. When the shade is in a raised position such as shown in FIG. 2, the loop will be much longer and extend well below the bottom rail. As can be seen in FIGS. 2 and 4 in the preferred embodiment the fabric 2 obscures the front of the bottom rail at all times.

Because the rib is not sewn to the fabric it is possible to change the spacing of the attachment points of the ribs to the fabric after the product has been assembled. Thus, if a fabricator makes a mistake or wants to change the look of the shade after it has been partially or fully assembled he can easily do this. This also gives the fabricator the ability to customize the length of the loops for each installation.

A wide variety of hardware and accessories can be used for my Roman shade. I particularly prefer to use the headrail and lift mechanism of my U.S. Pat. No. 5,184,660. I also prefer to use the cord lock disclosed in my U.S. Pat. No. 5,275,222. However, any other headrail, lift mechanism, and cord lock which have been used for Roman shades could be used in this Roman shade.

Although I have shown certain present preferred embodiments of Roman shades, it is to be distinctly understood that this invention is not limited thereto but may be variously embodied within the scope of the following claims.

I claim:

1. An improved Roman shade of the type consisting of a sheet of fabric connected between a bottom rail and a headrail and gathered at selected intervals to provide a series of cascading transverse pleats and lift cords for raising and lowering the shade wherein the improvement comprises:

a. a plurality of spacer cords attached between the headrail and the bottom rail;

b. a set of generally U-shaped ribs each rib comprised of a pair of legs connected together at a proximate end to form a top of the rib and abutting one another at their distal end to define a fabric receiving cavity therebetween; and c. at least one cord carrier attached to each rib and connected to one of the spacer cords, each cord carrier having a hole through which one of the lift cords passes, wherein the generally U-shaped ribs grip the fabric at selected intervals to form the series of cascading transverse pleats in the fabric when the shade is in an open position and in a fully closed position.

2. The improved Roman shade as claimed in claim 1 wherein the cord carriers are molded onto one of the spacer cords.

3. The improved Roman shade as claimed in claim 1 wherein the ribs are ABS plastic.

4. The improved Roman shade as claimed in claim 1 wherein the ribs extend across a full width of the fabric.

5. The improved Roman shade as claimed in claim 1 wherein the cord carriers are detachable from the ribs.

6. The improved Roman shade as claimed in claim 1 wherein the fabric extends over a front face of the headrail creating its own valance.

7. The improved Roman shade as claimed in claim 1 wherein the at least one cord carrier is attached to the top of the rib.

8. An improved Roman shade of the type consisting of a sheet of fabric connected between a bottom rail and a headrail and gathered at selected intervals to provide a series of cascading transverse pleats and lift cords for raising and lowering the shade wherein the improvement comprises:

a. plurality of spacer cords attached between the headrail and the bottom rail;

b. a set of generally U-shaped ribs each rib comprised of a pair of legs connected together at a proximate end to form a top of the rib and abutting one another at their distal end to define a fabric receiving cavity therebetween; and at least one cord carrier attached to one of the legs, wherein the generally U-shaped ribs grip the fabric at selected intervals to form the series of cascading transverse pleats in the fabric when the shade is in an open position and in a fully closed position.

9. The improved Roman shade as claimed in claim 8 wherein the cord carriers each have a hole through which one of the lift cords passes.

10. The improved Roman shade as claimed in claim 8 wherein the cord carriers are molded onto one of the spacer cords.

11. The improved Roman shade as claimed in claim 8 wherein the ribs are ABS plastic.

12. The improved Roman shade as claimed in claim 8 wherein the ribs extend across a full width of the fabric.

13. The improved Roman shade as claimed in claim 8 wherein the cord carriers are detachable from the ribs.

14. The improved Roman shade as claimed in claim 8 wherein the fabric extends over a front face of the headrail creating its own valance.

15. A spacer for Roman shades of the type consisting of a sheet of fabric connected between a bottom rail and a headrail and gathered at selected intervals to provide a series of cascading transverse pleats comprising:

a. at least one spacer cord;

b. a set of generally U-shaped ribs each rib comprised of a pair of legs connected together at a proximate end to form a top of the rib and abutting one another at their distal end to define a fabric receiving cavity therebetween; and c. at least one cord carrier attached to each rib and connected to one of the at least one spacer cord, each cord carrier having a hole sized to permit passage of a lift cord therethrough, wherein the generally U-shaped ribs are sized and shaped to grip the fabric at selected intervals to form a series of cascading transverse pleats in the fabric.

16. The spacer as claimed in claim 15 wherein the cord carriers are molded onto the spacer cord.

17. The spacer as claimed in claim 15 wherein the ribs are ABS plastic.

18. The spacer as claimed in claim 15 wherein the cord carriers are detachable from the ribs.

19. The spacer as claimed in claim 15 wherein the at least one cord carrier is attached to the top of the rib.

20. The spacer as claimed in claim 15 wherein the at least one cord carrier is attached to one of the legs.

* * * * *